US006481906B1

(12) United States Patent
Ikeda

(10) Patent No.: US 6,481,906 B1
(45) Date of Patent: Nov. 19, 2002

(54) METHOD OF CORRECTING A SHEET CONVEYANCE ERROR AND AN APPARATUS THEREFOR

(75) Inventor: Mamoru Ikeda, Tokyo (JP)

(73) Assignee: NEC Corporation, Tokyo (JP)

( * ) Notice: Subject to any disclaimer, the term of this patent is extended or adjusted under 35 U.S.C. 154(b) by 81 days.

(21) Appl. No.: 09/584,286

(22) Filed: May 31, 2000

(30) Foreign Application Priority Data

Jun. 3, 1999 (JP) ..... 11-156867

(51) Int. Cl.[7] ..... B41J 13/00
(52) U.S. Cl. ..... 400/578; 400/582; 400/902
(58) Field of Search ..... 400/578, 579, 400/580, 581, 582, 583.3, 545, 568, 902

(56) References Cited

U.S. PATENT DOCUMENTS 4,384,500 A * 5/1983 Friberg ..... 83/74
5,803,624 A * 9/1998 Miazga et al. ..... 400/103

FOREIGN PATENT DOCUMENTS

| | | | |
|---|---|---|---|
| JP | 63-149175 | * 6/1988 | |
| JP | 63-135277 | 7/1988 | ..... B41J/19/76 |
| JP | 63-137876 | 9/1988 | ..... B41J/19/76 |
| JP | 4-312869 | * 11/1992 | |

* cited by examiner

*Primary Examiner*—Andrew H. Hirshfeld
*Assistant Examiner*—Minh Chau
(74) *Attorney, Agent, or Firm*—Michael Best & Friedrich, LLC

(57) ABSTRACT

A method of correcting a conveyance error of a continuous sheet having a train of segments each including a respective segment mark and being conveyed for printing in accordance with the number of steps is disclosed. The method counts steps between consecutive segment marks during conveyance of the sheet to thereby output an actual number of steps, compares the actual number of steps with a preselected number of steps determined by a distance between the consecutive segment marks, and corrects, based on the result of comparison, the start of a new line at even positions of a single segment during subsequent conveyance. An apparatus for practicing the method is also disclosed.

17 Claims, 2 Drawing Sheets

METHOD OF CORRECTING A SHEET CONVEYANCE ERROR AND AN APPARATUS THEREFOR

BACKGROUND OF THE INVENTION

The present invention relates to a printer for printing an image on a sheet while conveying the sheet and more particularly to a method of correcting a sheet conveyance error and an apparatus therefor.

Printers extensively used today include a printer of the type using a continuous sheet made up of a train of segments. Each segment of this kind of sheet is provided with a respective segment mark beforehand. The problem with this type of printer is that by simply sensing the segment mark of the first segment to cause it to start at a preselected position, it is impossible to prevent an image from being shifted on the last segment. Because the shift of an image is ascribable even to the varying environment and the deterioration of a platen, it cannot be obviated by mechanical adjustment. Moreover, a conveyance error is apt to occur due to, e.g., an error in the diameter of the platen. Such errors would accumulate and also bring about the shift of an image.

In light of the above, it has been proposed to correct a conveyance error at the time of starting a new line. Japanese Patent Laid-Open Publication Nos. 63-1352277 and 63-137876, for example, each teach a system that provides a printing medium with marks and correct the positional error of a new line at the time of printing without regard to the kind of a new line pitch or the amount of a new line. However, the new line width corrected by the systems taught in the above documents is constant, so that an odd conveyance error of, e.g., ½ step and ⅓ step cannot be corrected. The systems therefore cannot obviate the shift of an image and make it difficult to print an image at the preselected position of a preselected format.

SUMMARY OF THE INVENTION

It is therefore an object of the present invention to provide a method capable of correcting the conveyance error of a sheet to thereby insure constant, accurate conveyance, and an apparatus therefor.

It is another object of the present invention to provide a printer capable of conveying a sheet constantly and accurately and easily printing an image at the preselected position of a preselected format.

In accordance with the present invention, a method of correcting the conveyance error of a continuous sheet having a train of segments each including the respective segment mark and being conveyed for printing in accordance with the number of steps begins with a step of counting the steps between consecutive segment marks during conveyance of the sheet to thereby output an actual number of steps. The actual number of steps is compared with a preselected number of steps determined by a distance between the consecutive segment marks to thereby output a result of comparison. The start of a new line is corrected on the basis of the result of comparison at even positions of a single segment during subsequent conveyance.

Also, in accordance with the present invention, an apparatus for correcting the conveyance error of a continuous sheet having a train of segments each including the respective segment mark and being conveyed for printing in accordance with a number of steps includes a counting section for counting the steps between consecutive segment marks during conveyance of the sheet to thereby output an actual number of steps. A comparing section compares the actual number of steps with a preselected number of steps determined by a distance between the consecutive segment marks to thereby output a result of comparison. A correcting section corrects, based on the result of comparison, the start of a new line at even positions of a single segment during subsequent conveyance.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
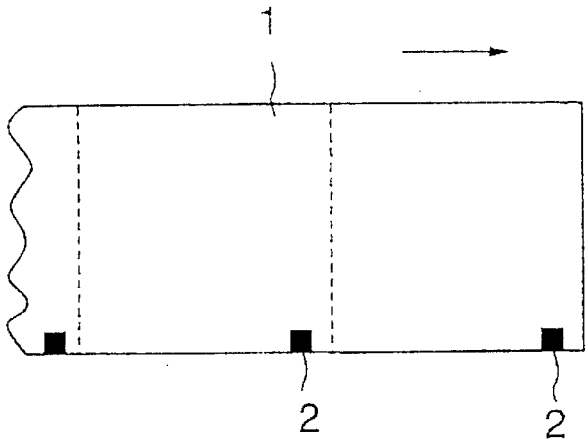
FIG. 1 is a fragmentary plan view showing a continuous sheet having a series of segments on which segment marks are printed beforehand.

Referring to FIG. 1 of the drawings, a continuous sheet 1 apapplicable to a thermal line printer, which is a specific form of a printer, is shown. As shown, the sheet 1 has a train of segments divided by dotted lines and is conveyed in a direction indicated by an arrow. Segment marks 2 each are printed on the right edge of the respective segment in the vicinity of the leading edge.

Figure 2:
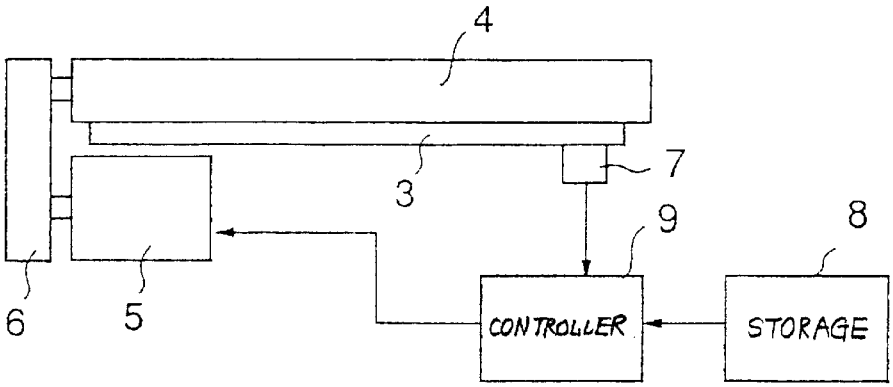
FIG. 2 is a block diagram schematically showing a thermal printer operable with the continuous sheet.

A specific configuration of the thermal line printer is shown in FIG. 2. As shown, the printer includes a thermal head 3 for printing images on the sheet 1 with heat. A platen 4 faces the thermal head 3 and conveys the sheet 1 by being driven by a feed motor 5. A gearbox 6 accommodates a gear mechanism, not shown, for transferring the output torque of the feed motor 5 to the platen 4. A mark sensor 7 senses the segment mark 2 of each segment of the sheet 1 being conveyed. A storage 8 stores a preselected number of steps determined by the distance between nearby segment marks 2. A controller 9 controllably drives the feed motor 5 in accordance with a signal output from the mark sensor 7 and the preselected number of steps, as will be described more specifically later. The feed motor 5 is implemented by a stepping motor whose rotation angle is controlled in accordance with the number of steps.

When the printer having the configuration of FIG. 2 sequentially prints images on the consecutive segments of the sheet 1 of FIG. 1, a range between the position where the mark sensor 7senses the first segment mark 2 and the position where it senses the second segment mark 2 is a single segment. So long as the conveyance of the sheet 1 is free from an error, the next segment mark 2 is surely sensed if the feed motor 5 is driven by a number of steps corresponding to the preselected number of steps. However, when an error occurs in the conveyance, the mark sensor 2 senses the second segment mark 2 before the feed motor 5 reaches the preselected number of steps or does not sense it even after the feed motor 5 has reached the preselected number of steps.

To obviate the above occurrence, the illustrative embodiment counts the steps of the feed motor 5 during the interval between the sensing of the first segment mark 2 and the sensing of the next segment mark following the printing of a single segment. The number of steps counted (actual number of steps hereinafter) is compared with the preselected number of steps stored in the storage 8.

Figure 3:
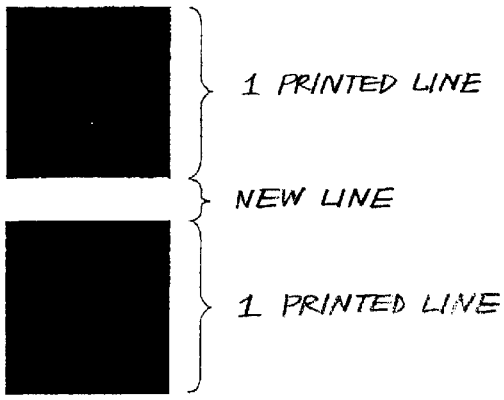
FIG. 3 is a view showing the start of a new line in accordance with a conveyance error correcting method embodying the present invention.

Referring also to FIG. 3, if the actual number of steps is smaller than the preselected number of steps, a difference between the former and the latter is evenly omitted from the new line portions of the next segment when an image is printed on the segment. If the actual number of steps is greater than the preselected number of steps, a difference between the former and the latter is evenly added to the new line port ions of the above segment. In this manner, a conveyance error is adequately corrected.

More specifically, assume that the thermal line printer has the following specifications:

| | |
|---|---|
| line step | one line = one step |
| print feed line | one line = 0.125 mm |
| line | one character = thirty-two lines |
| | one new line = eight lines |

When the printer with the above specifications prints an image on a 100 mm long segment, the number of lines is twenty, the number of print feed lines is 800, and an adequate number of steps (preselected number of steps) is 800.

Assume that an error of +1% occurred in the conveyance of the sheet 1. Then, the sheet 1 is conveyed by 101 mm when 800 lines are fully printed thereon. Stated another way, the sheet 1 is conveyed by 100 mm when only 792 lines are printed thereon, causing the mark sensor 7 to sense the next segment mark 2. That is, 792 steps are counted between the sensing of the first segment mark 2 and the sensing of the next segment mark 2. 792 steps is smaller than 800 steps, or preselected number of steps, by eight steps (1 mm).

In such a case, when an image is printed on the next segment of the sheet 1, the number of steps between the lines is evenly reduced by one once for a distance of 12.5 mm over the entire segment so as to correct the error. The prerequisite is that one step be omitted at the time of a new line after the printing of characters; should one step be omitted during printing of characters, the characters would be smeared out. More specifically, because the third line is being printed at the position corresponding to 12.5 mm, the new line width between the third and fourth lines is reduced by one line, implementing seven lines.

On the other hand, when the conveyance error is −1%, the sheet 1 is conveyed only by 99 mm when 800 lines are fully printed on its first segment. Stated another way, the mark sensor 7 senses the next segment mark 2 when 808 lines are printed on the first segment; that is 808 steps are counted between the sensing of the first segment mark 2 and the sensing of the next segment mark 2. 808 steps is greater than the preselected 800 steps by eight steps (1 mm). In this case, when an image is printed on the next segment of the sheet 1, the number of steps between the lines is evenly increased by one step once for the distance of 12.5 mm so as to correct the error. This must also be done at the time of a new line after the printing of characters; otherwise, the characters would become discontinuous. Again, because the third line is being printed at the position corresponding to 12.5 mm, the new line width between the third and fourth lines is increased by one line, implementing nine lines.

Figure 4:
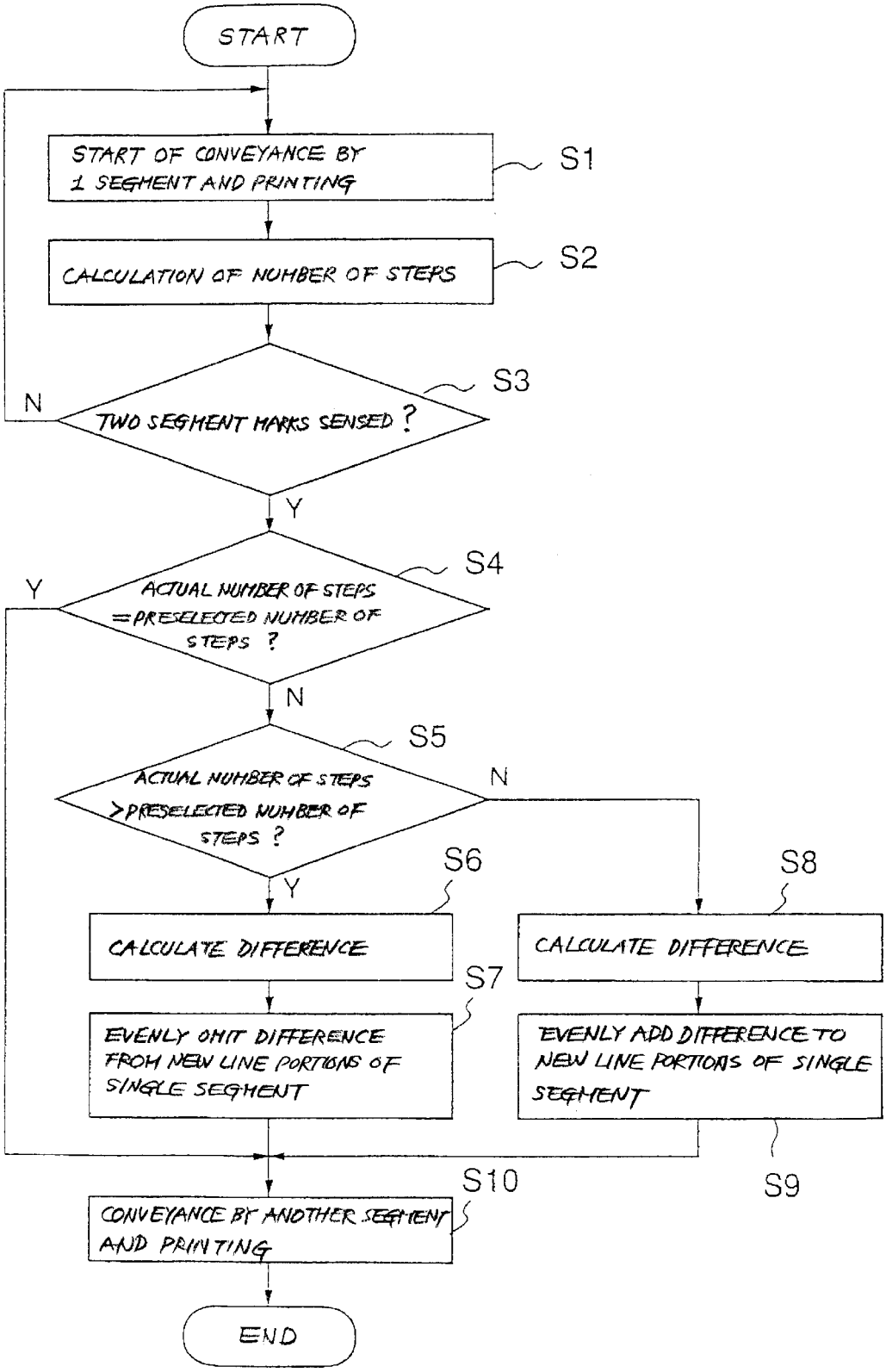
FIG. 4 is a flowchart demonstrating a specific operation of the illustrative embodiment.

Reference will be made to FIG. 4 for describing the operation of the illustrative embodiment, i.e., the controller 9 more specifically. As shown, after the start of the operation, the controller 9 drives the feed motor 5 in order to convey the sheet 1. At the same time, the controller 9 causes the thermal head 3 to print an image on the first segment of the sheet 1 (step S1). The controller 9 counts the number of steps of the feed motor 5 (step S2) and, in this sense, plays the role of counting means.

Subsequently, the controller 9 determines whether or not the mark sensor 7 has sensed two consecutive segment marks 2 (step S3). If the answer of the step S3 is positive (Y), the controller 9 determines that the sheet 1 has been successfully conveyed by a single segment. The controller 9 then determines whether or not the actual number of steps counted is equal to the preselected number of steps (step S4). If the answer of the step S4 is Y, the controller 9 continues the conveyance of the sheet 1 and prints an image on the next segment (step S10). If the answer of the step S4 is negative (N), the controller 9 determines whether or not the actual number of steps is greater than the preselected number of steps (step S5). In the steps S4 and S5, the controller 9 serves as comparing means.

If the answer of the step S5 is Y, the controller 9 produces a difference between the actual number of steps and the preselected number of steps (step S6). At this instant, the controller 9 plays the role of difference calculating means.

After the step S6, the controller 9 evenly omits the difference between the actual number of steps and the preselected number of steps from the new line portions of the next segment of the sheet 1 (step S7). The step S7 is followed by the step S10. As for the step S7, the controller 9 serves as omitting means.

If the answer of the step S5 is N, meaning that the actual number of steps is smaller than the preselected number of steps, the controller 9 calculates a difference between the former and the latter (step S8). At this instant, too, the controller 9 serves as difference calculating means. Subsequently, the controller 9 the evenly adds the above difference to the new line portions of the next segment of the sheet 1 (step S9) and, in this sense, plays the role of adding means. The omitting means and adding means constitute step correcting means in combination. Further, the difference calculating means and step correcting means constitute correcting means in combination.

While the illustrative embodiment has concentrated on a thermal line printer, the present invention is similarly applicable to a thermal serial printer.

In summary, it wiII be seen that the present invention provides a sheet conveyance error correcting method and an apparatus therefor capable of compensating for the influence of irregularity in the diameter of a platen and the expansion and contraction of a sheet ascribable to the varying environment, thereby insuring accurate sheet conveyance. This successfully obviates the shift of an image on the sheet, i.e., allows an image to be accurately printed at the preselected position of a preselected format without fail.

Various modifications will become possible for those skilled in the art after receiving the teachings of the present disclosure without departing from the scope thereof.

What is claimed is:

1. A method of correcting a conveyance error of a continuous sheet having a train of segments each including a respective segment mark and being conveyed for printing in accordance with a pre-selected number of steps between said segment marks, said method comprising:

presorting said pre-selected number;

printing a succession of evenly spaced plurality of lines on said sheet and between said segment marks, the distance between said printed lines being determined by the number of steps between said successive lines;

a counting step for counting the steps between consecutive segment marks during conveyance of the sheet to thereby output an actual number of steps;

a comparing step for comparing the actual number of steps with said pre-selected number of steps determined by a distance between the consecutive segment marks to thereby output a result of comparison; and a correcting step for correcting, based on the result of said comparison, a start of a new line at even positions on a single segment during a subsequent conveyance of said sheet, said correction step being carried out by adjusting the number of steps between said successive lines.

2. A method as claimed in claim 1, wherein said correcting step comprises:

a difference calculating step for calculating a difference between the actual number of steps and the preselected number of steps; and said step correcting step for evenly allocating the difference to a single segment and correcting said difference at new line portions.

3. A method as claimed in claim 2, wherein said step correcting step comprises:

an omitting step for evenly omitting, when the actual number of steps is greater than the preselected number of steps, the difference from the new line portions of a single segment; and an adding step for evenly adding, when the actual number of steps is smaller than the preselected number of steps, the difference to the new line portions of a single segment.

4. A method as claimed in claim 3, wherein the sheet is conveyed by a stepping motor control ably driven in accordance with the number of steps.

5. A method as claimed in claim 2, wherein the sheet is conveyed by a stepping motor controllably driven in accordance with the number of steps.

6. A method as claimed in claim 1, wherein the sheet is conveyed by a stepping motor controllably driven in accordance with the number of steps.

7. A method of correcting a conveyance error of a continuous sheet having a train of segments, comprising the steps of:

counting, while the sheet is conveyed, steps consumed to control a feed motor between consecutive segment marks provided on consecutive segments of said sheet to thereby output an actual number of steps;

comparing the actual number of steps with a preselected number of steps to thereby calculate a difference;

printing a succession of lines on said sheet, the distances between said lines being determined by the number of said feed motor steps; and correcting, the distances between said lines based on the difference, new line portions being located at even positions of a single segment during a subsequence conveyance.

8. An apparatus for correcting a conveyance error of a continuous sheet having a train of segments each including a respective segment mark and being conveyed for printing successive lines in accordance with a number of steps, between said lines said apparatus comprising:

counting means for counting the steps between consecutive segment marks during conveyance of the sheet to thereby output an actual number of steps;

comparing means for comparing the actual number of steps with a preselected number of steps determined by a distance between the consecutive segment marks to thereby output a result of comparison; and correcting a spacing between said successive lines means for correcting, based on the result of said comparison, thus cause a start of a new line at even positions of a single segment during a subsequent conveyance.

9. An apparatus as claimed in claim 8, wherein said correcting means comprises:

difference calculating means for calculating a difference between the actual number of steps and the preselected number of steps; and step correcting means for evenly allocating the difference to a single segment and correcting said difference at new line portions.

10. An apparatus as claimed in claim 9, wherein said step correcting means comprises:

an omitting means for evenly omitting, when the actual number of steps is greater than the preselected number of steps, the difference from the new line portions of a single segment; and adding means for evenly adding, when the actual number of steps is smaller than the preselected number of steps, the difference to the new line portions of a single segment.

11. An apparatus as claimed in claim 10, wherein the sheet is conveyed by a stepping motor controllably driven in accordance with the number of steps.

12. An apparatus as claimed in claim 9, wherein the sheet is conveyed by a stepping motor controllably driven in accordance with the number of steps.

13. An apparatus as claimed in claim 8, wherein the sheet is conveyed by a stepping motor controllably driven in accordance with the number of steps.

14. In a printer including an apparatus for correcting a conveyance error of a continuous sheet having a train of segments each including a respective segment mark and being conveyed for printing in accordance with a number of steps, said apparatus comprises:

printing means for printing successive lines on said sheet;

counting means for counting the steps between consecutive segment marks during a conveyance of the sheet to thereby output an actual number of steps;

said comparing means for comparing the actual number of steps with a preselected number of steps determined by a distance between the consecutive segment marks to thereby output a result of comparison; and correcting means for correcting, spacing between said printed lines, said correction of said spacing being based on the result of said comparison, and starting a new line or print at even position relative to a single segment mark during a subsequent conveyance.

15. A printer as claimed in claim 14, wherein said correcting means comprises:

difference calculating means for calculating a difference between the actual number of steps and the preselected number of steps; and step correcting means for evenly al locating the difference to a single segment and correcting said difference at new line portions.

16. A printer as claimed in claim 15, wherein said step correcting means comprises:

an omitting mans for evenly omitting, when the actual number of steps is greater than the preselected number of steps, the difference from the new line portions of a single segment; and an adding means for evenly adding, when the actual number of steps is smaller than the preselected number of steps, the difference to the new line portions of a single segment.

17. A printer as claimed in claim 14, wherein the sheet is conveyed by a stepping motor control lably driven in accordance with the number of steps.

* * * * *